US007412183B2

(12) United States Patent
Isoda

(10) Patent No.: US 7,412,183 B2
(45) Date of Patent: Aug. 12, 2008

(54) IMAGE FORMING APPARATUS INCLUDING A BILLING UNIT, A METHOD FOR CONTROLLING THE IMAGE FORMING APPARATUS, A CONTROL PROGRAM, AND A COMPUTER-READABLE STORE MEDIUM

(75) Inventor: Takashi Isoda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 11/294,079

(22) Filed: Dec. 5, 2005

(65) Prior Publication Data

US 2006/0133838 A1 Jun. 22, 2006

(30) Foreign Application Priority Data

Dec. 17, 2004 (JP) ..... 2004-366699

(51) Int. Cl.
*G03G 21/02* (2006.01)

(52) U.S. Cl. ..... 399/79; 399/80

(58) Field of Classification Search ..... 399/75, 399/79–82

See application file for complete search history.

(56) References Cited

U.S. PATENT DOCUMENTS

| | | | | |
|---|---|---|---|---|
| 4,313,673 | A * | 2/1982 | Wartinger et al. | 399/79 |
| 6,112,039 | A * | 8/2000 | Salgado et al. | 399/79 |
| 6,385,675 | B1 * | 5/2002 | Yamaguchi | 399/79 |

FOREIGN PATENT DOCUMENTS

| | | | |
|---|---|---|---|
| JP | 04-338767 | A | 11/1992 |
| JP | 09-190123 | A | 7/1997 |
| JP | 10-207310 | | 8/1998 |
| JP | 11-125949 | A | 5/1999 |
| JP | 2003-016523 | | 1/2003 |
| JP | 2003-256177 | | 9/2003 |
| JP | 2003-280468 | A | 10/2003 |
| JP | A 2004-170811 | | 6/2004 |

OTHER PUBLICATIONS

The above references were cited in a Dec. 25, 2007 Japanese Office Action issued in the counterpart Japanese Patent Application 2005-347940, which is enclosed without translation.
The above listed references were cited in a Mar. 24, 2008 Japanese Office Action issued in the counterpart Japanese Patent Application No. 2005-347940, which is enclosed without translation.

* cited by examiner

*Primary Examiner*—William J Royer
(74) *Attorney, Agent, or Firm*—Cowan, Liebowitz & Latman, P.C.

(57) ABSTRACT

An image forming apparatus includes an image data input unit; an image forming unit adapted to print an image on a printing sheet in accordance with image data from the image data input unit; a control unit connected to the image forming unit; and a billing setting unit adapted to enable to selectively set either a first mode for billing per side of the printing sheet or a second mode for billing per sheet of the printing sheet for double-sided printing, wherein the control unit executes a printing service in accordance with the set mode by the billing setting unit.

9 Claims, 13 Drawing Sheets

FIG. 8

| | MONOCHROME / COLOR | |
|---|---|---|
| | MONOCHROME | COLOR |
| SIZE | | |
| B5 | 10 YEN | 50 YEN |
| B4 | 10 YEN | 50 YEN |
| B3 | 20 YEN | 70 YEN |
| B2 | 30 YEN | 100 YEN |
| A5 | 10 YEN | 50 YEN |
| A4 | 10 YEN | 50 YEN |
| A3 | 20 YEN | 70 YEN |
| A2 | 30 YEN | 100 YEN |

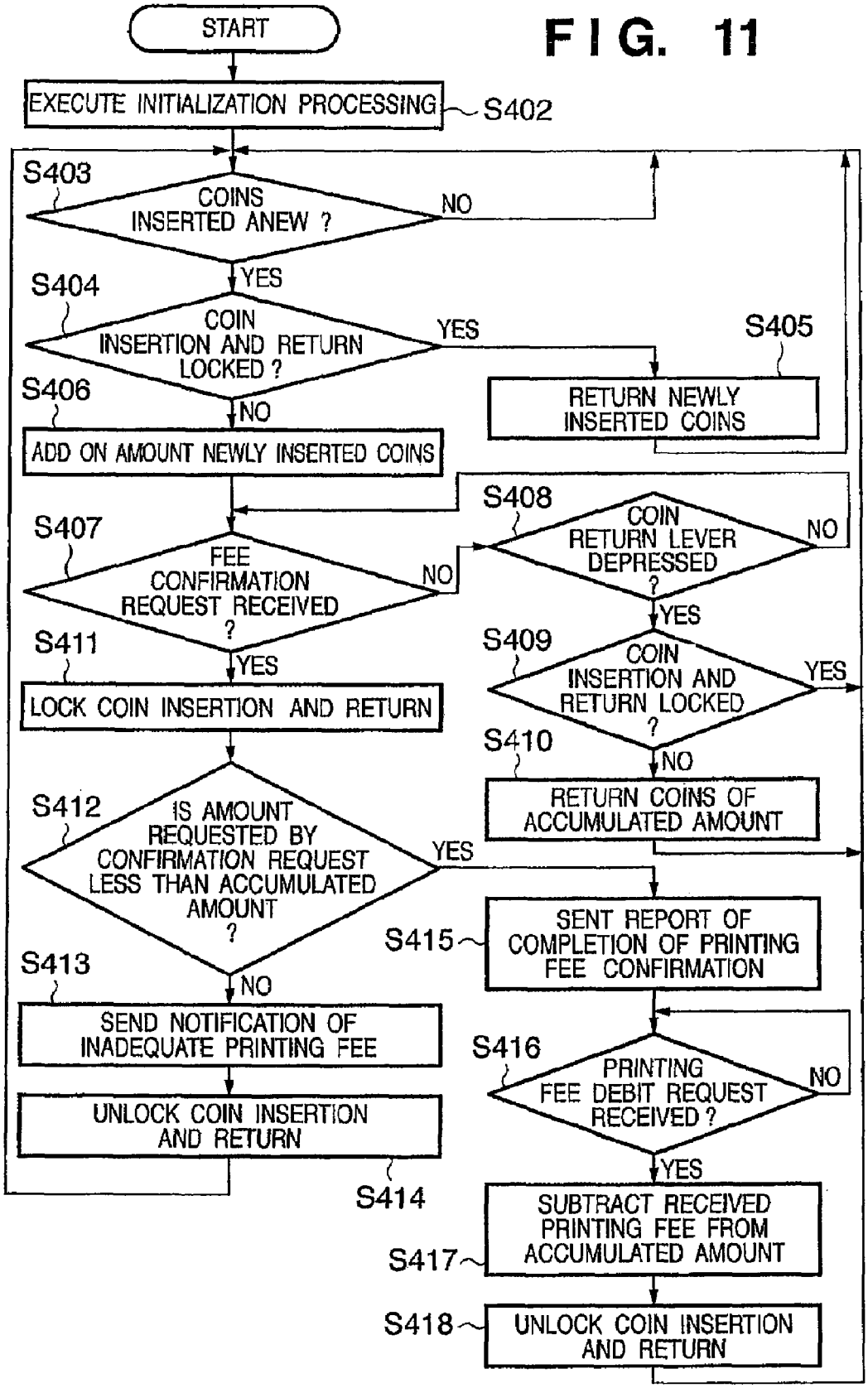
FIG. 11
START
EXECUTE INITIALIZATION PROCESSING
S402
S403
COINS INSERTED ANEW ?
NO
YES
S404
COIN INSERTION AND RETURN LOCKED ?
YES
S405
RETURN NEWLY INSERTED COINS
S406
NO
ADD ON AMOUNT NEWLY INSERTED COINS
S408
COIN RETURN LEVER DEPRESSED ?
NO
S407
FEE CONFIRMATION REQUEST RECEIVED ?
NO
YES
S411
YES
S409
COIN INSERTION AND RETURN LOCKED ?
YES
LOCK COIN INSERTION AND RETURN
S410
NO
RETURN COINS OF ACCUMULATED AMOUNT
S412
IS AMOUNT REQUESTED BY CONFIRMATION REQUEST LESS THAN ACCUMULATED AMOUNT ?
YES
S415
SENT REPORT OF COMPLETION OF PRINTING FEE CONFIRMATION
S413
NO
SEND NOTIFICATION OF INADEQUATE PRINTING FEE
S416
PRINTING FEE DEBIT REQUEST RECEIVED ?
NO
UNLOCK COIN INSERTION AND RETURN
YES
S414
SUBTRACT RECEIVED PRINTING FEE FROM ACCUMULATED AMOUNT
S417
S418
UNLOCK COIN INSERTION AND RETURN

IMAGE FORMING APPARATUS INCLUDING A BILLING UNIT, A METHOD FOR CONTROLLING THE IMAGE FORMING APPARATUS, A CONTROL PROGRAM, AND A COMPUTER-READABLE STORE MEDIUM

FIELD OF THE INVENTION

This invention relates to an image forming apparatus and to a method of controlling this apparatus.

BACKGROUND OF THE INVENTION

It is well known that an image forming apparatus bills a fee for a print service such as copying and printing when such service is provided.

Another proposed apparatus among these types of image forming apparatus deals with a billing process in a case where job data is received, but an error occurs when image data contained in the received job data is converted to a bitmap (see the specification of Japanese Patent Application Laid-Open No. 2003-256177).

With an image forming apparatus of this kind, however, a problem has arisen when billing for a double-sided printing service if such print service is provided. Specifically, after the completion of printing on one side of a sheet of paper, the following printing operation is suspended without completing printing on the other side, the problem is whether to bill the user for the printing service of the one side. Since the user was expecting printing on both sides, it may be unreasonable for the user to pay compensation even though only single-sided printed matter is obtained. From the standpoint of the billing side, however, since at least the printing of one side was completed and the print service was provided to the user, so that the billing side wishes to bill for the compensation for the single-sided printing. In other words, a conflict can occur between the billing side and the user side when an incomplete service has been provided.

Accordingly, an object of the present invention is to provide an image forming apparatus and method thereof, in which double-sided printing service can be billed appropriately.

SUMMARY OF THE INVENTION

According to the present invention, the foregoing object is attained by providing an image forming apparatus comprising: an image data input unit; an image forming unit adapted to print an image on a printing sheet in accordance with image data from the image data input unit; a control unit connected to the image forming unit; and a billing setting unit adapted to enable to selectively set either a first mode for billing per side of the printing sheet or a second mode for billing per printing sheet for double-sided printing; wherein the control unit executes a printing service in accordance with the set mode by the billing setting unit.

According to another embodiment of the present invention, the foregoing object is attained by providing a method of controlling an image forming apparatus which comprises: an image data input step; an image forming step of printing an image on a printing sheet in accordance with image data from the image data input step; a control step; and a billing setting step of enabling to selectively set either a first mode for billing per side of the printing sheet or a second mode for billing per printing sheet for double-sided printing; wherein the control step executes a printing service in accordance with the set mode in the billing setting step.

Thus, in accordance with the present invention, there can be provided an image forming apparatus and method of controlling same whereby a printing service can be billed for appropriately.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 8 is a diagram illustrating an example of a billing setting table within the copy machine;

FIG. 11 is an example of a flowchart of operation of the coin-operated controller according to this embodiment.

DETAILED DESCRIPTION OF THE PREFERRED EMBODIMENTS

A preferred embodiment of the present invention will now be described in detail with reference to the accompanying drawings. The structural elements set forth in the embodiment are for the purpose of illustration only and in no way limit the scope of the present invention.

Figure 1:
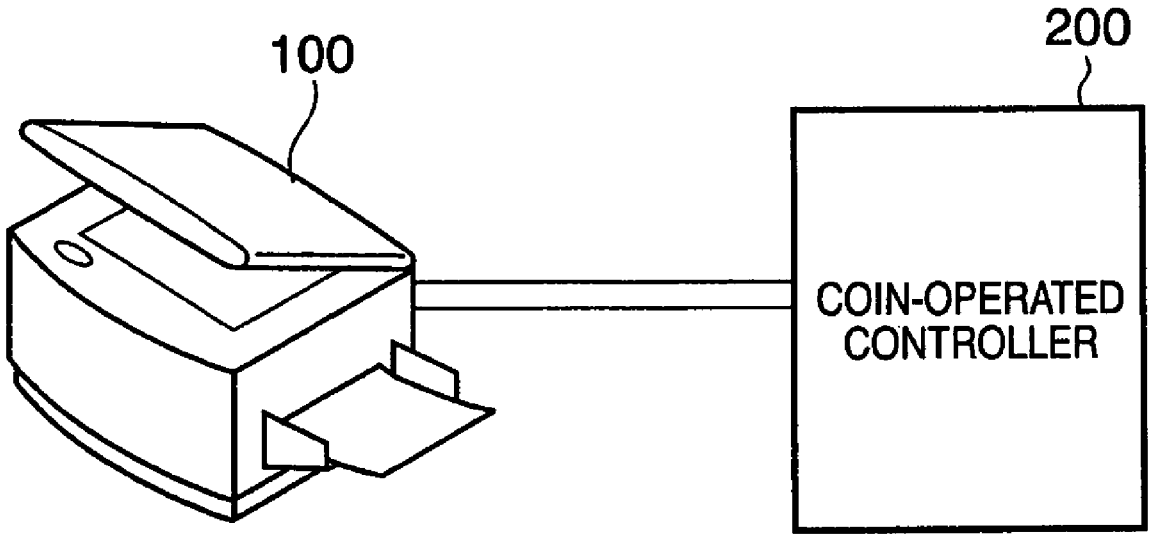
FIG. 1 is a diagram illustrating the configuration of the system of an image forming apparatus according to an embodiment of the present invention.

FIG. 1 is a diagram illustrating the configuration of the system according to this embodiment. The system comprises a copy machine 100 serving as an image forming apparatus, and a coin-operated controller 200 serving as a fee collecting apparatus. These are connected by a highly reliable communication line such as a LAN cable, wireless-LAN communication cable or RS232C, USB or IEEE-1394 cable. An installation personnel installs the system, which is obtained by connecting the copy machine 100 and coin-operated controller 200, at a location such as a convenience store and sets up a billing procedure by operating the copy machine 100 or coin-operated controller 200. A customer visiting the convenience store inserts money into the coin-operated controller 200 in order to receive a printing service and then operates the copy machine 100 to receive the printing service within the limits of the amount of money paid.

Figure 2:
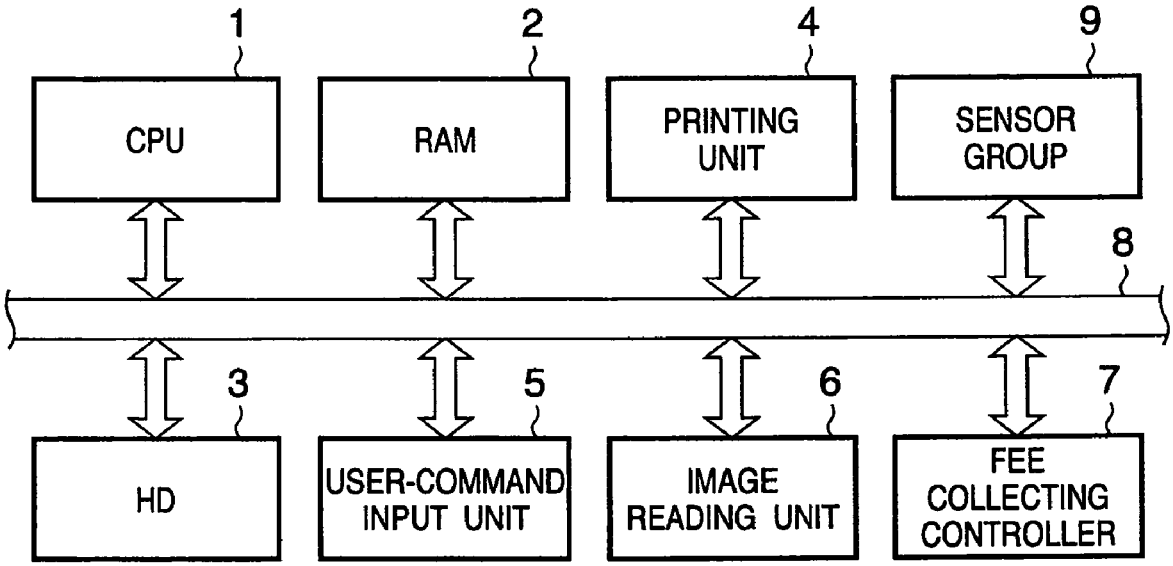
FIG. 2 is a block diagram illustrating the structure of a copy machine according to an embodiment of the present invention.

FIG. 2 is a block diagram illustrating the internal structure of the copy machine 100 of FIG. 1. The copy machine 100 includes a CPU (Central Processing Unit) 1 for controlling the overall apparatus; a RAM 2 that provides a working area for the CPU 1; a hard disk 3 that provides application program and stores various settings; a printing unit 4 for printing on printing paper; a user-command input unit 5 from which a user (inclusive of a customer and installation personnel) sets the copy machine 100; an image reading unit 6 for reading an original document; a fee collecting controller 7 for communicating with the coin-operated controller 200; a sensor group 9; and a main bus 8. In this embodiment, the printing unit 4 prints using toner, although the printing unit 4 may employ ink-jet printing. The sensor group 9 includes a residual-toner sensor for sensing the amount of toner remaining in the printing unit 4, a paper-edge sensor for sensing jamming of the printing paper in the paper transport path, paper absence/presence sensor for sensing whether or not there is printing paper in a paper feed unit, etc. In order to store such various settings related to the above, a Floppy (registered trademark) disk or semiconductor non-volatile RAM besides the hard disk 3 may be used.

Unless specifically stated otherwise, the copy machine 100 of this embodiment is such that the CPU 1 controls the RAM 2, hard disk 3, printing unit 4, user-command input unit 5, image reading unit 6, fee collecting controller 7 and sensor group 9 via the main bus 8.

Figure 3:
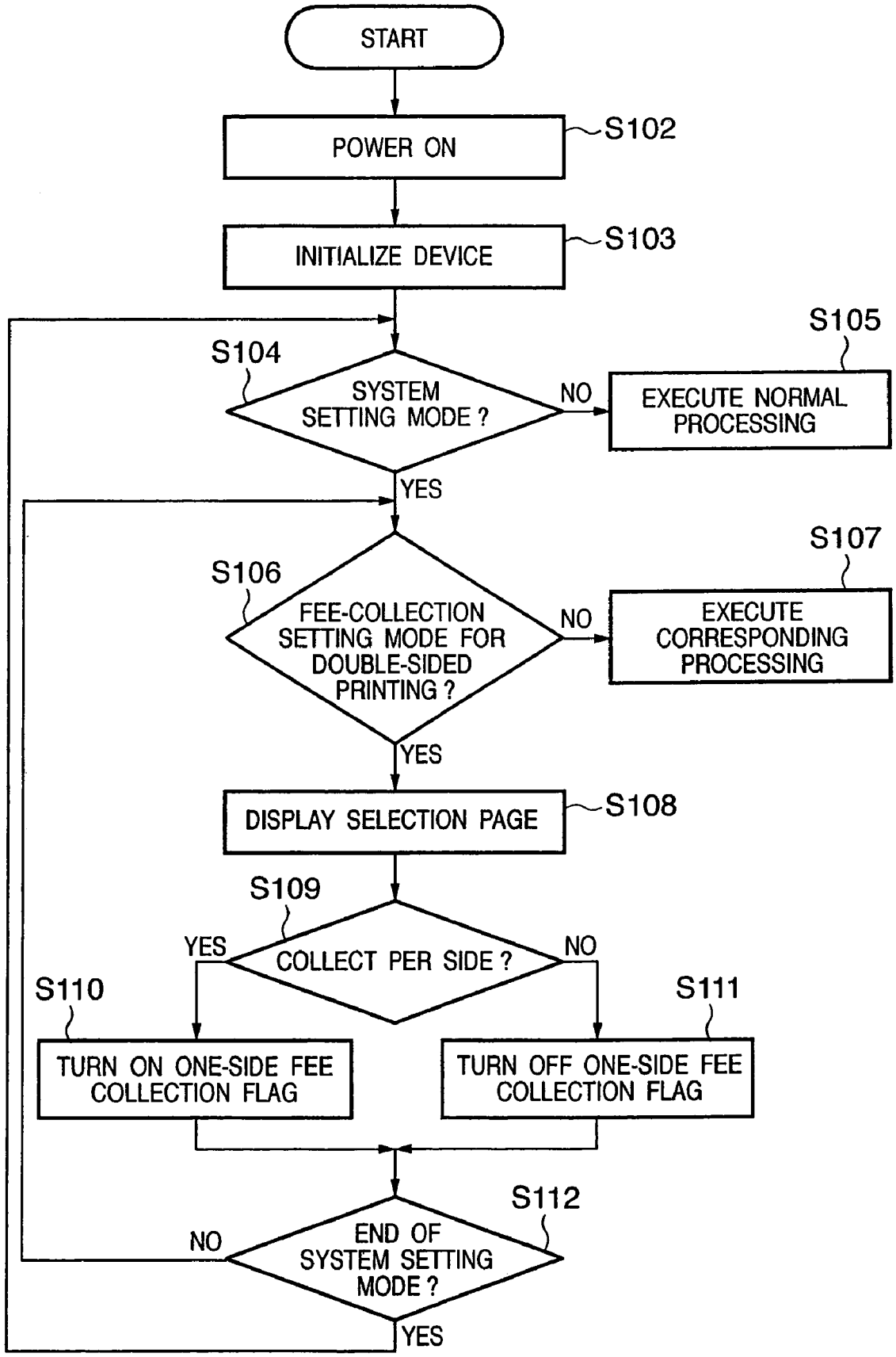
FIG. 3 is a flowchart illustrating a method of setting a copy machine according to the embodiment of the present invention.

First, initialization of the copy machine 100 will be described in detail with reference to the flowchart of FIG. 3.

At first, power is introduced to the copy machine 100 to start up the copy machine 100 (S102) and the necessary initialization processing is executed within the copy machine 100 (S103). It is determined whether the system has been placed in a system setting mode by an input from the user-command input unit 5 (S104). When the system is placed in the system setting mode, authentication as by password, ID card, etc. is required. Thus it is so arranged that a customer who pays a fee and utilizes the copy machine 100 for printing service cannot freely change the setting of the billing procedure. If the system is not placed in the system setting mode, then the system transitions to a normal-use mode and executes the processing corresponding to the input (S105).

In the system setting mode, it is possible to selectively set either a first mode for billing for a printing service for printing on one side of a printing sheet when printing on this one side ends, and for billing for printing on the other side when printing of an image on the other side ends, or a second mode for billing for a double-sided printing service when forming of images on both sides of the printing sheet ends.

Figure 4:
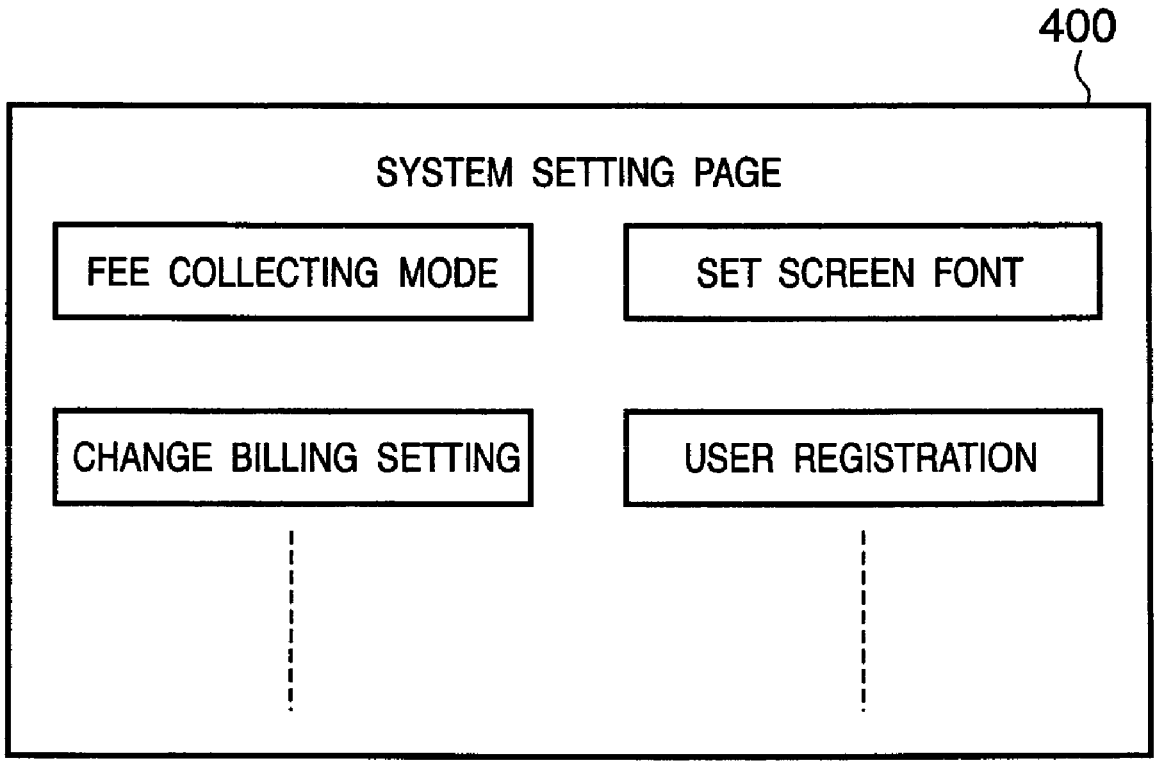
FIG. 4 is a diagram illustrating a system setting page image of the copy machine according to this embodiment.

More specifically, a user interface image 400 on which a system setting page of the kind shown in FIG. 4, for example, appears is displayed on the user-command input unit 5. It is determined whether a fee-collection setting mode for double-sided printing has been selected (step S106). If the fee-collection setting mode is not selected through the user-command input unit 5, then the corresponding processing is executed (S107).

Figure 5:
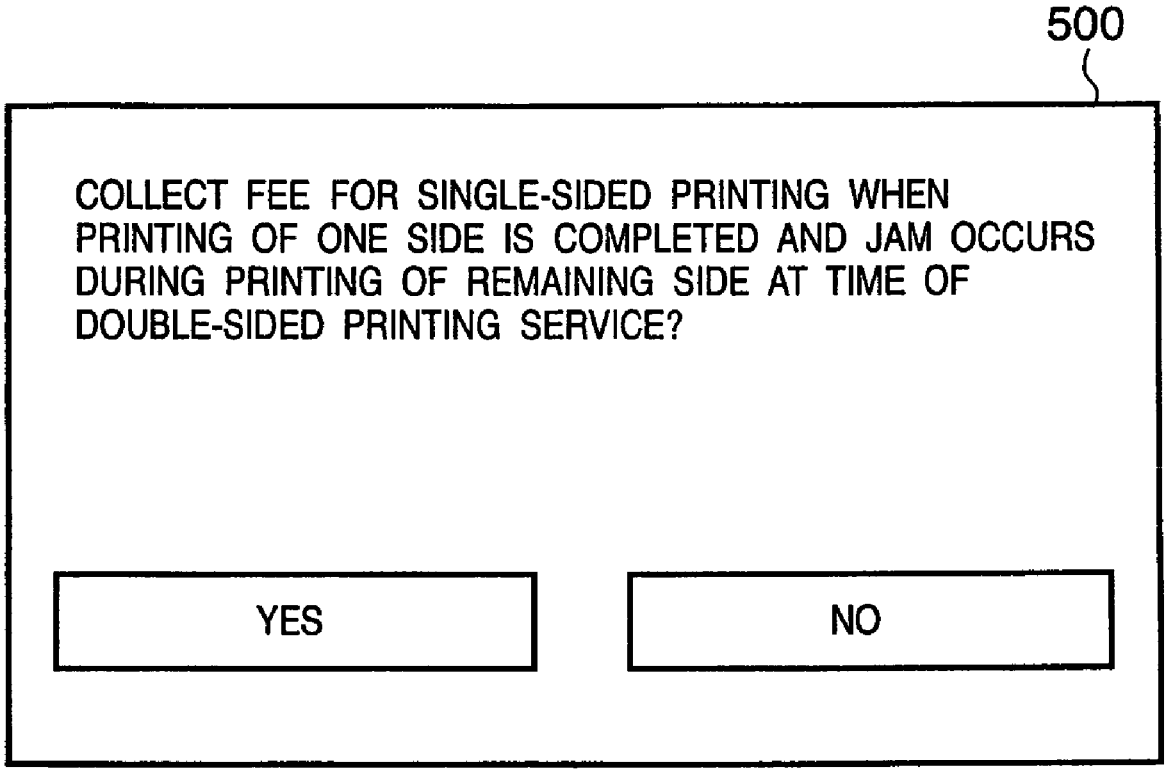
FIG. 5 is a diagram illustrating a setting page image of the copy machine according to this embodiment.

However, if the fee-collection setting mode has been selected, then a user interface image 500 of a selection page of the kind shown in FIG. 5, for example, is displayed on the user-command input unit 5 (S108). By way of example, a message is displayed and inquires as to whether a fee for printing on one side should be collected or not when printing on one side has been completed but jamming has occurred during printing on the other side in a double-sided printing service. In this case, it will suffice to display a message simply inquiring as to whether to bill on a single-side basis or double-side basis. A further message which is permissible is one inquiring as to whether to bill per printed side or per number of paper sheets.

If the installation personnel selects "YES" at the user-command input unit 5, then control proceeds from step S109 to step S110. Here a single-side fee collection flag is turned ON and is stored in a storage area of the hard disk 3. The system transitions to the above-described first mode in response.

Further, if the installation personnel selects "NO" at the user-command input unit 5, then control proceeds from step S109 to step S111. Here the single-side fee collection flag is turned OFF and is stored in a storage area of the hard disk 3. The system transitions to the above-described second mode in response.

Next, a selection is made as to whether to terminate the system setting mode through the user-command input unit 5 (S112). If termination is selected, then control returns to S104; otherwise, control returns to S106.

The description rendered above assumes that the installation personnel sets the billing units selectively. However, this does not impose a limitation upon the invention and it may be so arranged that these settings can be made by the user who requests printing. In such case, however, the user requesting printing cannot change the setting relating to the billing rate.

The normal processing operation of the copy machine 100 will be described in detail with reference to FIG. 8 and FIGS. 9A, 9B.

Figure 9A:
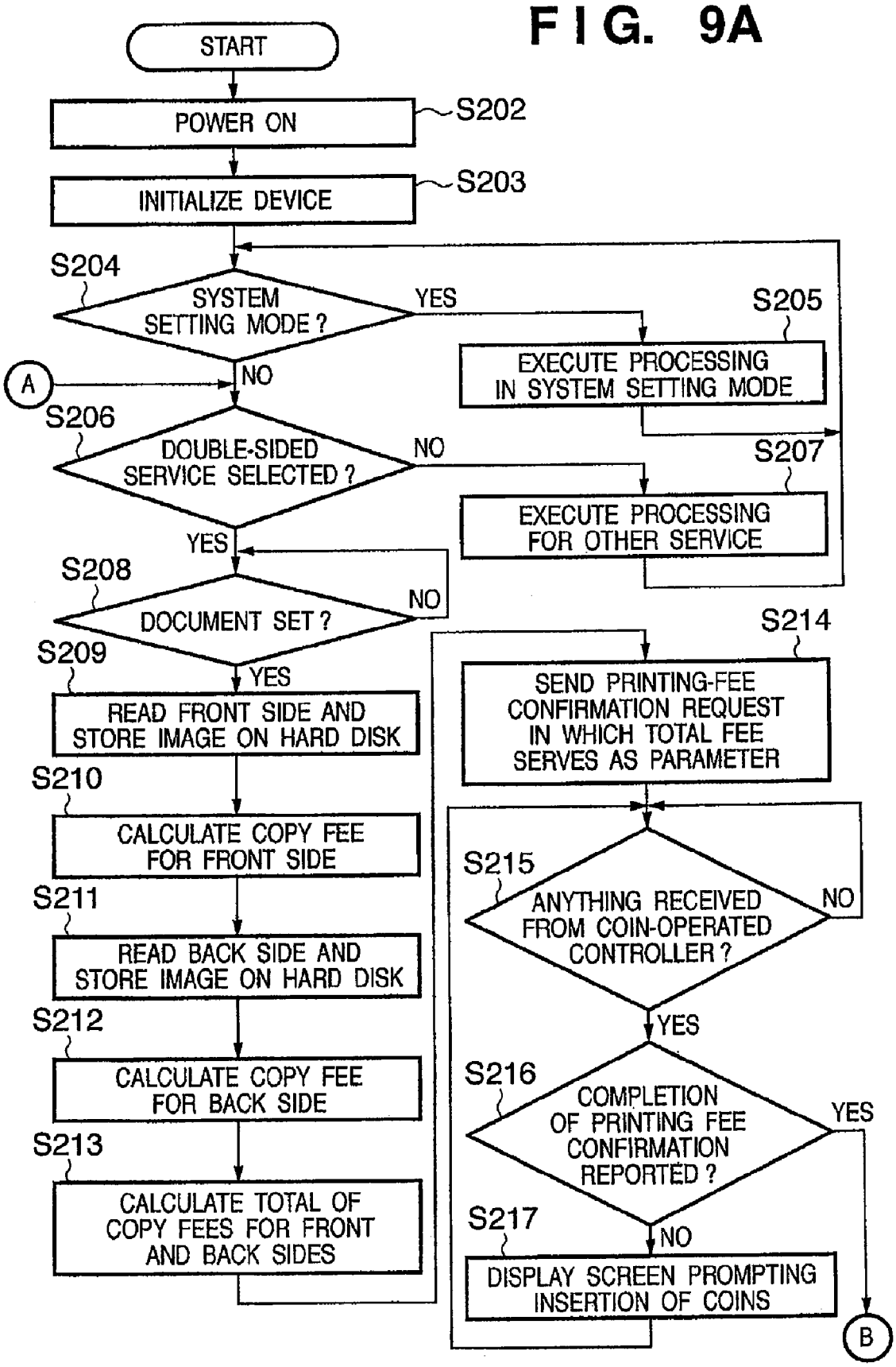
FIGS. 9A and 9B are flowcharts illustrating the operation of the copy machine according to this embodiment.
Figure 9B:
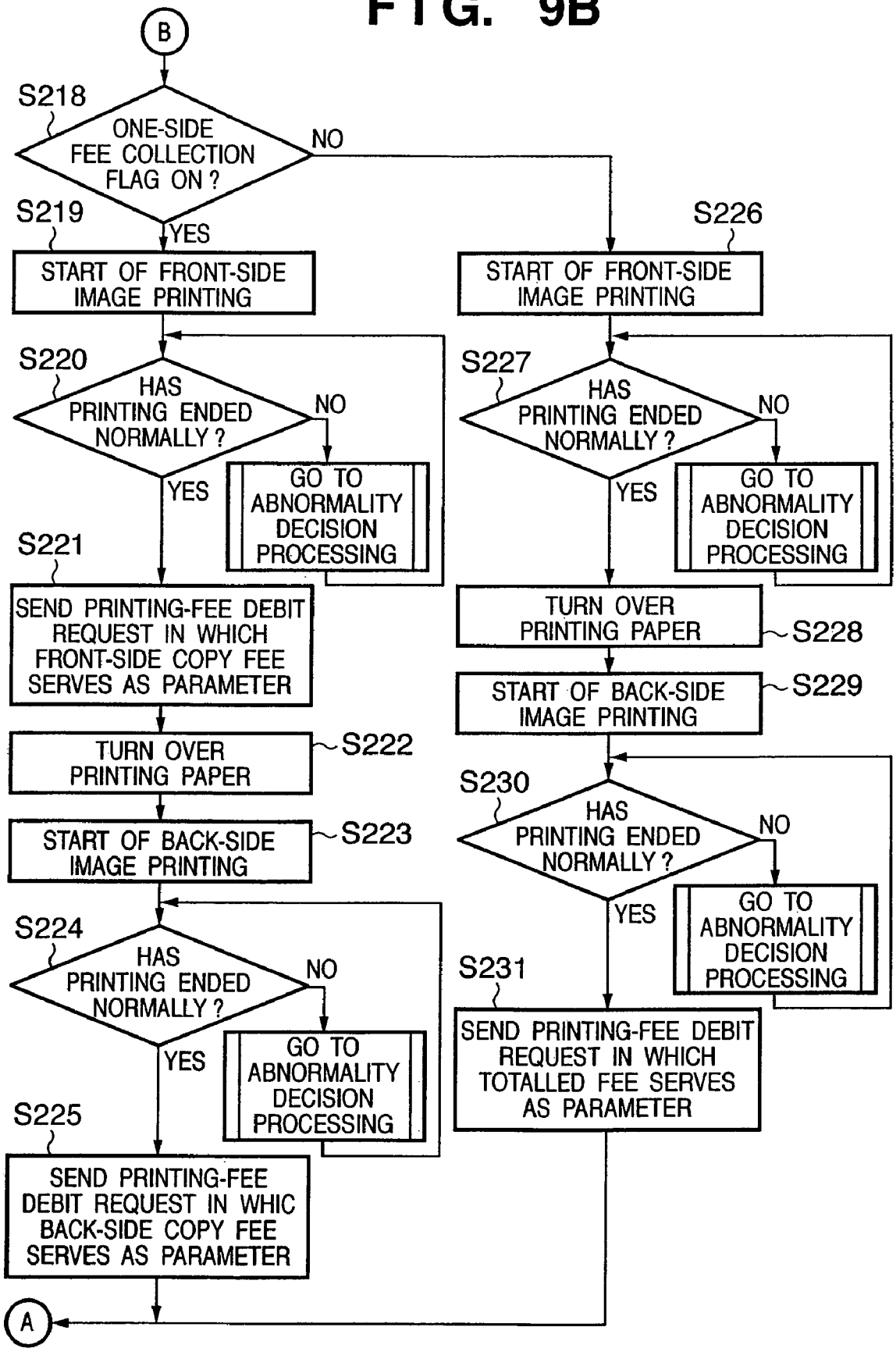

First, in FIG. 9A, power is introduced to start up the copy machine 100 (S202) and internal initialization of the copy machine is performed (S203)

After initialization is completed, a selection is made through the user-command input unit 5 as to whether the system should be placed in the system setting mode (S204). If the system setting mode is selected, then processing in the system setting mode is executed (S205). However, if the normal mode is selected, then it is determined whether the user has selected the double-sided printing service (S206). If another mode has been selected, then the corresponding service process is executed (S207) and control returns to step S204.

If the user has selected the double-sided printing service, then the system waits for an original document to be placed on the image reading unit 6 (S208). At this time a page for setting the fee collecting procedure using steps S108 to S111 in FIG. 3 may be displayed and may prompt the user to confirm his/her settings. For example, it will suffice to display a message reading "THIS APPARATUS HAS BEEN SET TO BILL PER PRINTED SIDE" or "THIS APPARATUS HAS BEEN SET TO COLLECT A SINGLE-SIDE PRINTING FEE IF PRINTING ENDS IN AN ERROR WHEN ONLY A SINGLE SIDE HAS BEEN PRINTED". This makes it possible for the user to use the copy machine 100 upon agreeing to the billing setting.

If the original document has been set in place, the front side of the document is read by the image reading unit 6 and the image is stored on the hard disk 3 in the form of electronic data (S209). It is determined whether the read document is color or monochrome, the size of the paper is determined, the fee for copying the front side is calculated from a fee calculating table of the kind shown in FIG. 8 and the fee is finalized (S210). The document is then turned over, the back side of the document is also read by the image reading unit 6 and the image is stored on the hard disk 3 in the form of electronic data (S211). It is determined whether the read document is color or monochrome, the size of the paper is determined, the fee for copying the back side is calculated from the fee calculating table shown in FIG. 8 and the fee is finalized (S212). The copy fee for the front side and the copy fee for the back side are totalled and the total fee for double-sided copying is calculated (S213). It should be noted that the determination as to whether a color or monochrome copying operation is to be performed is assumed to be made by automatic discrimination of the color of the document. However, a method may be adopted in which the user specifies the copying mode through the user-command input unit 5, etc. In such case the fee billed can be reduced if the user decides monochrome will suffice for the desired image copy even if the original document is in color.

Next, a fee confirmation request in which the total fee serves as a parameter is sent to the coin-operated controller 200 via the fee collecting controller 7 (S214). The system then waits for a report from the coin-operated controller 200 (S215). If a report or notification from the coin-operated controller 200 is received via the fee collecting controller 7, it is determined whether the content received is a report that confirmation of the printing fee has been completed or a notification that the printing fee is inadequate (S216). If what has been received is notification of printing fee inadequacy, then it is judged that the amount inserted into the coin-operated controller 200 is less than the compensation for the double-sided printing service and a screen prompting the user to insert additional coins is displayed on the user-command input unit 5 (S217). Control then returns to S215. If what has been received is a report to the effect that confirmation of the printing fee has been completed, then it is judged that the amount inserted into the coin-operated controller 200 is the same as or greater than the compensation for the double-sided printing service and it is decided that execution of the double-sided printing service is possible. Next, as illustrated in FIG. 9B, it is determined whether the single-side fee collection flag, which has been stored on the hard disk 3, is ON or OFF (step S218).

If the single-side fee collection flag is ON, the image data on the front side of the original document stored on the hard disk 3 is extracted. Printing of the front side is started using the printing unit 4 (S219). A check is made to determine whether an abnormality such as paper jamming, depletion of toner or depletion of paper has occurred during printing (S220). If an abnormality such as mentioned above has occurred, then abnormality decision processing is executed. If a command to suspend print processing is issued by the user during abnormality decision processing, the processing indicated by this flowchart ends. If printing can be resumed during abnormality decision processing, then control returns to step S220.

If printing is found to end normally at step S220, then a printing-fee debit request in which the copy fee for the front side serves as a parameter is sent to the coin-operated controller 200 via the fee collecting controller 7 (S221). The printing paper is then turned over to prepare for printing on the back side (S222). The electronic data representing the image on the back side of the original document stored on the hard disk 3 is extracted. Printing of the back side is started using the printing unit 4 (S223). A check is made to determine whether an abnormality such as paper jamming, depletion of toner or depletion of paper has occurred during printing (S224). If an abnormality has occurred, then abnormality decision processing is executed. If a command to suspend print processing is issued by the user during abnormality decision processing, the processing indicated by this flowchart ends. If printing can be resumed during abnormality decision processing, then control returns to step S220.

If printing ends normally, then a printing-fee debit request in which the copy fee for the back side serves as a parameter is sent to the coin-operated controller 200 via the fee collecting controller 7 (S225). Control then returns to step S206 shown in FIG. 9A.

If the single-side fee collection flag is OFF, then the image data representing the front side of the original document stored on the hard disk 3 is extracted. Printing of the front side is started using the printing unit 4 (S226). A check is made to determine whether an abnormality such as paper jamming, depletion of toner or depletion of paper has occurred during printing (S227). If an abnormality has occurred, then abnormality decision processing is executed. If a command to suspend print processing is issued by the user during abnormality decision processing, the processing indicated by this flowchart ends. If printing can be resumed during abnormality decision processing, then control returns to step S227.

If printing ends normally, then the printing paper is then turned over to prepare for printing on the back side (S228). The image data on the back side of the original document stored on the hard disk 3 is extracted. Printing of the back side is started using the printing unit 4 (S229). A check is made to determine whether an abnormality such as paper jamming, depletion of toner or depletion of paper has occurred during printing (S230). If an abnormality has occurred, then abnormality decision processing is executed. If a command to suspend print processing is issued by the user during abnormality decision processing, the processing indicated by this flowchart ends. If printing can be resumed during abnormality decision processing, then control returns to step S230. If printing ends normally, then a printing-fee debit request in which the total fee of copy fees for the front and back sides serves as a parameter is sent to the coin-operated controller 200 via the fee collecting controller 7 (S231). Control then returns to step S206 shown in FIG. 9A.

Figure 10:
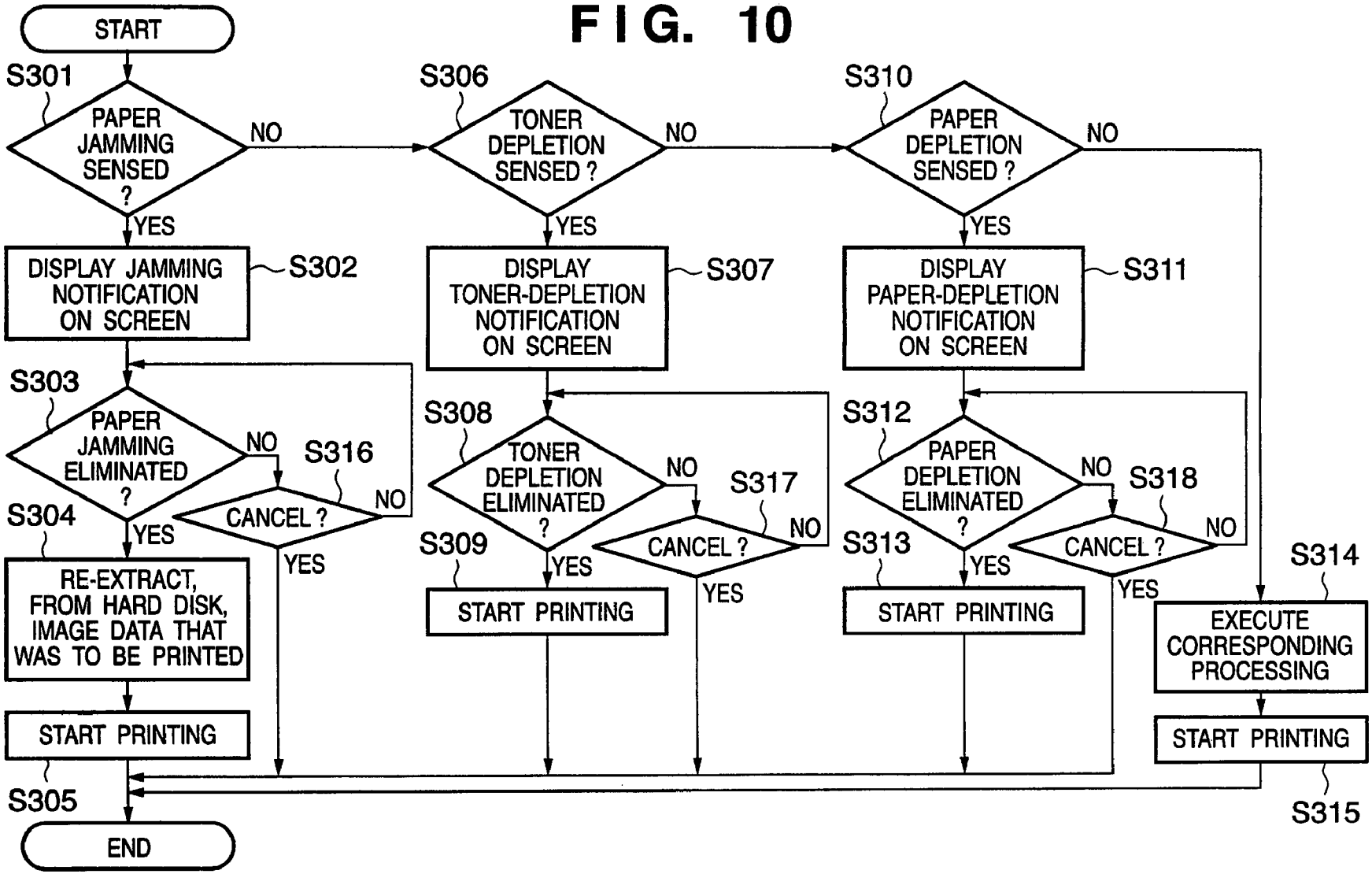
FIG. 10 is a flowchart of operation when an abnormality occurs during printing in the copy machine according to this embodiment.

Next, abnormality decision processing will be described in detail with reference to FIG. 10. It is determined whether paper jamming (S301), toner depletion (S306) or paper depletion (S310) has been detected as the cause of an abnormality. Paper jamming is sensed by the paper-edge sensor in the sensor group 9 and is discriminated by the CPU 1. Depletion of toner is sensed by the residual-toner sensor in the sensor group 9 and is discriminated by the CPU 1. Paper depletion is sensed by the paper absence/presence sensor in the sensor group 9 and is discriminated by the CPU 1. These discrimination steps are executed as front-side printing abnormality decision processing until printing of the front side ends. After printing of the front side ends, back-side printing abnormality decision processing is executed until ejection of the printing paper is completed, inclusive of turn-over of the printing paper.

If paper jamming has been sensed, notification of paper jamming is displayed on the user-command input unit 5 (S302). The system then waits for the paper jamming problem to be eliminated (S303). If paper jamming has been eliminated, the image data that was to be printed is extracted from the hard disk 3 again (S304) and printing is started (S305).

If depletion of toner has been sensed, notification of depletion of toner is displayed on the user-command input unit 5 (S307). The system then waits for the toner depletion problem to be eliminated (S308). If toner depletion has been eliminated, printing is started (S309).

If depletion of paper has been sensed, notification of depletion of paper is displayed on the user-command input unit 5 (S311). The system then waits for the paper depletion problem to be eliminated (S312). If toner depletion has been eliminated, printing is started (S313).

If another abnormality occurs, the corresponding processing is executed and the system waits for the problem to be solved (S314). If the problem has been solved, then printing is started (S315).

When it is determined whether various abnormalities have been eliminated or not, it is determined at the same time whether the user has entered a command to abort print processing (S316 to S318). If the user has entered a cancel command, then print processing per se is terminated.

Next, the operation of the coin-operated controller 200 will be described in detail with reference to FIG. 11.

Power is introduced and processing for internally initializing the coin-operated controller 200 is executed (S402). The system waits for the insertion of coins anew (S403). If coins have been inserted anew, it is determined whether coin insertion and coin return are presently locked (inhibited) (S404). If such locking is in effect, then newly inserted coins are returned (S405). If such locking is not in effect, the monetary amount of newly inserted coins is added to the amount that has already been inserted into the coin-operated controller 200 (S406). It is then determined whether a printing fee confirmation request has been received from the copy machine 100 (S407). If the request has not been received, it is determined whether a coin return lever has been operated (S408). If the lever has not been operated, step S407 is executed. If the coin return lever has been operated, it is determined whether coin insertion and coin return are presently locked (inhibited) (S409). If such locking is in effect, step S403 is executed. If locking is not in effect, then the entire amount that has been inserted into the coin-operated controller 200 is returned (S410).

If a printing fee confirmation request has been received, coin insertion and return are locked (S411). The monetary amount that has been transmitted as a parameter of the printing fee confirmation request and the monetary amount current inserted into the coin-operated controller 200 are compared (S412). If the former is smaller, then notification of an inadequate printing fee is sent to the copy machine 100 (S413) and the lock on coin insertion and return is eliminated (S414).

If the printing fee is equal to or greater, a report that confirmation of the printing fee has been completed is sent to the copy machine (S415) and the system waits for a printing-fee debit request from the copy machine (S416). If the printing-fee debit request has been received, then the printing fee that has been transmitted as the parameter of this debit request is subtracted from the monetary amount presently inserted (S417). Coin insertion and return are then unlocked (S418).

Figure 6:
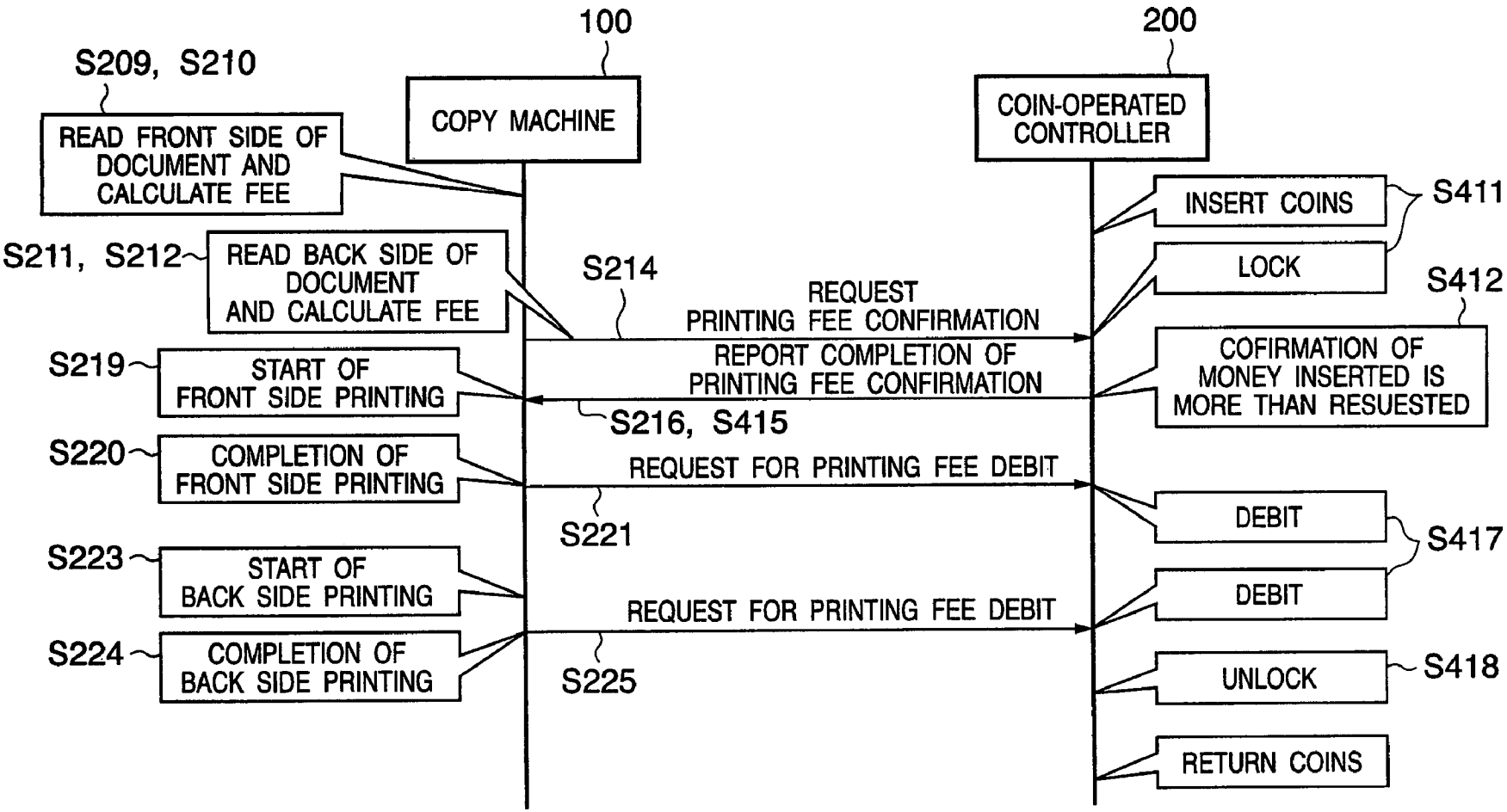
FIG. 6 is a timing chart illustrating the operation of the copy machine and of a coin-operated controller according to this embodiment.
Figure 7:
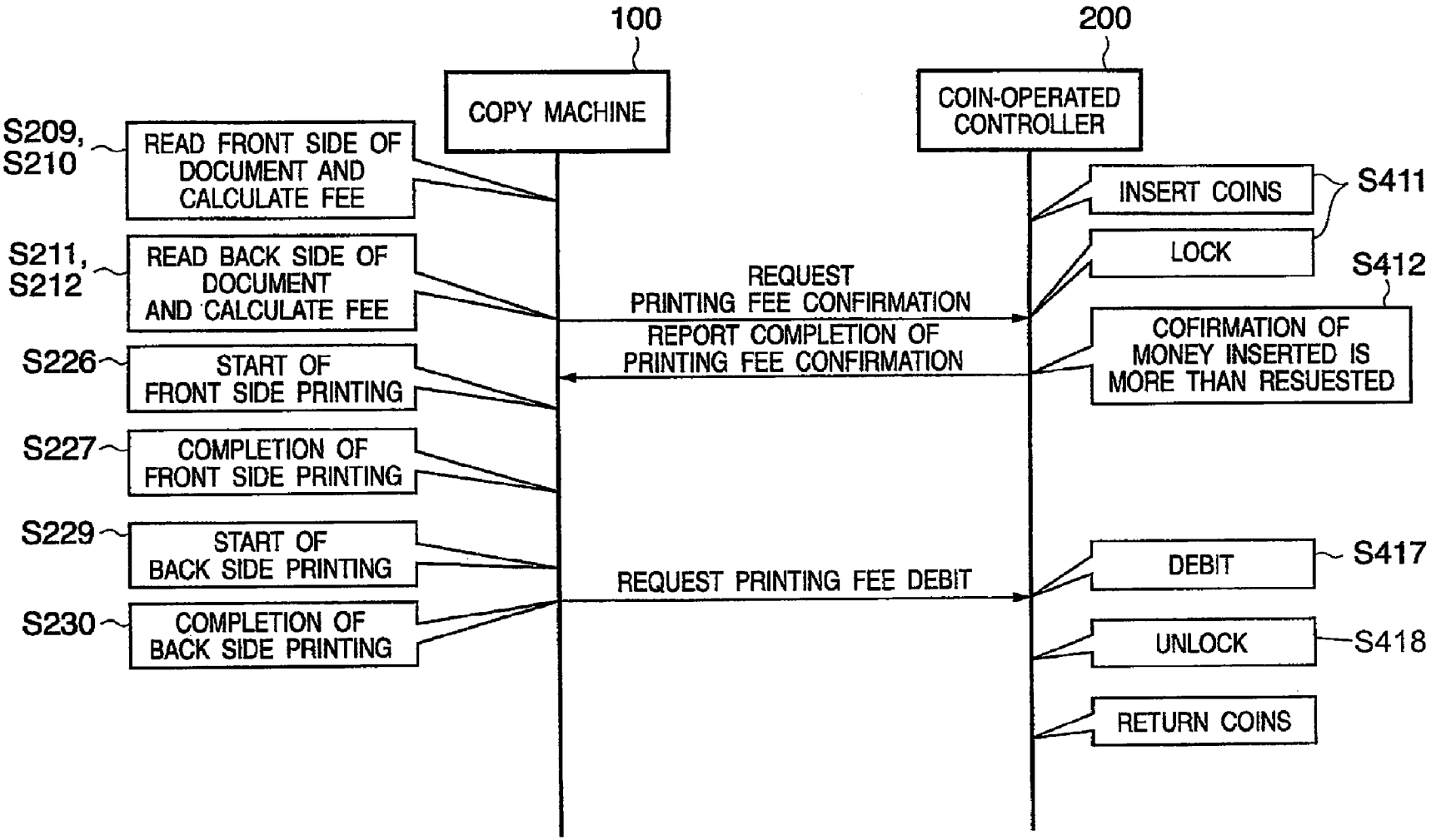
FIG. 7 is a timing chart illustrating the operation of the copy machine and of the coin-operated controller according to this embodiment.

FIGS. 6 and 7 are timing charts illustrating operations performed between the copy machine 100 and coin-operated controller 200.

FIG. 6 is a timing chart specialized for a case where billing is performed per printed side, and FIG. 7 is a timing chart specialized for a case where billing is performed per number of sheets of printing paper. Since the step numbers used in FIGS. 9 and 11 are shown attached to the corresponding processes, a detailed description of these flowcharts is omitted.

Figure 12:
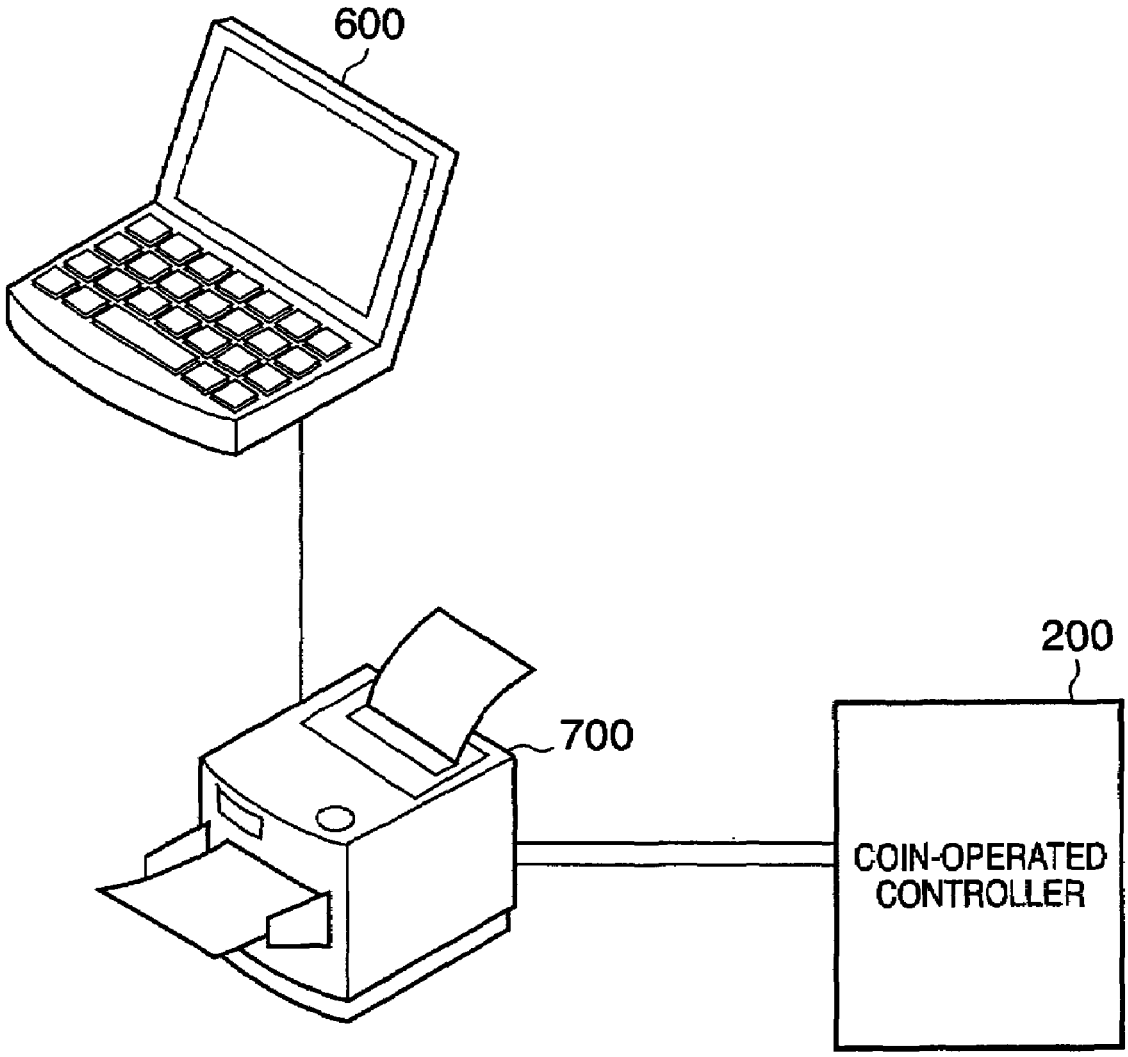
FIG. 12 is a diagram illustrating another example of a system to which the present invention is applicable.

In the embodiment set forth above, an arrangement based upon the copy machine 100 is described. However, it is possible to achieve the same effects also with a system of the kind shown in FIG. 12 comprising a terminal 600 such as a personal computer and a printer 700. For example, if the terminal 600 such as a personal computer converts an image to be printed to electronic data and stores this electronic data on the hard disk 3, it is possible to obtain the same effects as those of the foregoing embodiment. Further, it is possible to achieve similar effects also with a multifunction machine having a plurality of functions such as printing and copying functions.

It is permissible to set a default value as to whether a fee should be collected for single-sided printing when a jam process is implemented following the completion of single-sided printing at the time of a double-sided printing service. The initial value (the value set at the factory before shipping) of the default may be set to "DO NOT COLLECT FEE" or to "COLLECT FEE" (although if the installation personnel changes this value, then the new value is retained).

In the embodiment set forth above, the system setting mode and fee collection mode are set and the corresponding displays presented using the user-command input unit 5 inside the copy machine 100. However, the terminal 600 such as a personal computer having a monitor and console may be connected on the line connecting the copy machine 100 and the coin-operated controller 200, and the terminal 600 may be used to set and present the displays of the system setting mode and fee collection mode. Further, the terminal 600 such as a personal computer for specifying printing may be used to set and present the displays of the system setting mode and fee collection mode.

In the embodiment set forth above, printing paper is described as a printing sheet. However, it could be material having plural sides such as cloth, a board, metal, a stone, glass, a film, and vinyl as material of a print sheet.

Other Embodiments

Although an embodiment of the present invention has been described in detail, the present invention may also be applied to a system constituted by a plurality of devices or to an apparatus comprising a single device.

Furthermore, there are cases where the object of the invention is attained also by supplying a software program, which implements the functions of the foregoing embodiment, directly or remotely to a system or apparatus, reading the supplied program codes with a computer of the system or apparatus, and then executing the program codes. Accordingly, since the functions of the present invention are implemented by computer, the program codes per se installed in the computer also fall within the technical scope of the present invention.

In this case, so long as the system or apparatus has the functions of the program, the form of the program, e.g., object code, a program executed by an interpreter or script data supplied to an operating system, etc., does not matter.

Examples of recording media that can be used for supplying the program are a Floppy (registered trademark) disk, hard disk, optical disk, magneto-optical disk, CD-ROM, CD-R, CD-RW, magnetic tape, non-volatile type memory card, ROM, DVD (DVD-ROM, DVD-R), etc.

As for the method of supplying the program, a client computer can be connected to a website on the Internet using a browser possessed by the client computer, and the computer program per se of the present invention or an automatically installable compressed file of the program can be downloaded to a recording medium such as a hard disk.

Further, the program of the present invention can be supplied by dividing the program code constituting the program into a plurality of files and downloading the files from different websites.

In other words, a WWW (World Wide Web) server that downloads, to multiple users, the program files that implement the functions of the present invention by computer also is covered by the claims of the present invention.

Further, it is also possible to encrypt and store the program of the present invention on a storage medium such as a CD-ROM, distribute the storage medium to users, allow users who meet certain requirements to download decryption key information from a website via the Internet, and allow these users to run the encrypted program by using the key information, whereby the program is installed in the user computer.

Furthermore, besides the case where the aforesaid functions according to the embodiment are implemented by executing the read program by computer, an operating system or the like running on the computer may perform all or a part of the actual processing so that the functions of the foregoing embodiment can be implemented by this processing.

Furthermore, after the program read from the storage medium is written to a memory provided on a function expansion board inserted into the computer or in a function expansion unit connected to the computer, a CPU or the like mounted on the function expansion board or function expansion unit performs all or a part of the actual processing so that the functions of the foregoing embodiment can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Applications No. 2004-366699 filed on Dec. 17, 2004, the entire contents of which are hereby incorporated by reference herein.

What is claimed is:

1. An image forming apparatus capable of printing on both sides of a printing sheet, comprising:

an image data input unit adapted to input image data;

an image forming unit adapted to print an image on both sides of a printing sheet in accordance with image data input by said image data input unit;

a billing mode setting unit adapted to selectively set either a first billing mode or a second billing mode;

a billing unit adapted to bill for printing by said image forming unit per side of a printing sheet in a case where the first billing mode is set, and bill for printing by said image forming unit per a printing sheet in a case where the second billing mode is set; and a control unit adapted to cause said image forming unit to start printing on both sides of a printing sheet after confirming that there is a balance corresponding to bill for printing on both sides of a printing sheet both in the first billing mode and the second billing mode.

2. The apparatus according to claim 1, wherein the first billing mode is for billing when printing of an image on one side of a printing sheet ends and for billing also when printing of an image on the other side of the printing sheet ends; and the second billing mode is for billing when printing of images on both sides of a printing sheet ends.

3. The apparatus according to claim 1, wherein said image forming apparatus is connected to a fee collecting apparatus; and in the first billing mode, said billing unit issues a printing-fee debit request to said fee collecting apparatus at every time when an image is printed on a side of the printing sheet.

4. The apparatus according to claim 1, wherein the first billing mode is for billing for printing of an image on one side of a printing sheet even if an error occurs and an image is not printed on the other side of the printing sheet when printing of an image on the one side of the printing sheet ends; and the second billing mode is for refraining from billing if an error occurs and an image is not printed on the other side of the printing sheet when printing of an image on the one side of the printing sheet ends.

5. The apparatus according to claim 1, wherein said billing mode setting unit has a control panel adapted to input settings.

6. The apparatus according to claim 1, wherein said billing mode setting unit has a receiving unit adapted to receive settings.

7. The apparatus according to claim 1, wherein setting of billing mode in said billing mode setting unit requires authentication.

8. A method of controlling an image forming apparatus capable of printing on both sides of a printing sheet, comprising:

an image data input step adapted to input image data;

an image forming step of printing an image on both sides of a printing sheet in accordance with image data input in the image data input step;

a billing mode setting step of selectively setting either a first billing mode or a second billing mode;

a billing step of billing for printing in said image forming step per side of a printing sheet in a case where the first billing mode is set, and billing for printing in said image forming step per a printing sheet in a case where the second billing mode is set; and a control step of causing said image forming step to start printing on both sides of a printing sheet after confirming that there is a balance corresponding to bill for printing on both sides of a printing sheet both in the first billing mode and the second billing mode.

9. A control program, which is executable by a computer of an image forming apparatus capable of printing on both sides of a printing sheet, describing a method of controlling said image forming apparatus, said control program having:

an image data input step adapted to input image data;

an image forming step of printing an image on both sides of a printing sheet in accordance with image data input in the image data input step;

a billing mode setting step of selectively setting either a first billing mode or a second billing mode;

a billing step of billing for printing in said image forming step per side of a printing sheet in a case where the first billing mode is set, and billing for printing in said image forming step per a printing sheet in a case where the second billing mode is set; and a control step of causing said image forming step to start printing on both sides of a printing sheet after confirming that there is a balance corresponding to bill for printing on both sides of a printing sheet both in the first billing mode and the second billing mode.

* * * * *